US011565298B2

(12) United States Patent
Bruyas

(10) Patent No.: US 11,565,298 B2
(45) Date of Patent: Jan. 31, 2023

(54) BENDING DEVICE

(71) Applicant: NUMALLIANCE, Saint-Michel-sur-Meurthe (FR)

(72) Inventor: Jean-Paul Bruyas, Charly (FR)

(73) Assignee: NUMALLIANCE, Saint-Michel-sur-Meurthe (FR)

( * ) Notice: Subject to any disclaimer, the term of this patent is extended or adjusted under 35 U.S.C. 154(b) by 0 days.

(21) Appl. No.: 16/941,859

(22) Filed: Jul. 29, 2020

(65) Prior Publication Data

US 2021/0031255 A1 Feb. 4, 2021

(30) Foreign Application Priority Data

Jul. 30, 2019 (FR) ..... 1908654

(51) Int. Cl.
*B21D 7/16* (2006.01)
*B21D 7/04* (2006.01)
*B21D 7/08* (2006.01)

(52) U.S. Cl.
CPC ..... *B21D 7/16* (2013.01); *B21D 7/04* (2013.01); *B21D 7/085* (2013.01)

(58) Field of Classification Search
CPC . B21D 7/16; B21D 7/04; B21D 7/085; B21D 7/00; B21D 7/08; B21D 7/02; B21D 7/021; B21D 7/024; B21D 7/022; B21D 7/03
USPC ..... 72/149, 159
See application file for complete search history.

(56) References Cited

U.S. PATENT DOCUMENTS

| | | | | | |
|---|---|---|---|---|---|
| 4,959,984 | A * | 10/1990 | Trudell | B21D 7/024 | 72/150 |
| 6,220,069 | B1 * | 4/2001 | Wehmeyer | B21D 7/024 | 72/149 |
| 7,293,444 | B2 * | 11/2007 | Hacker | B21D 7/024 | 72/157 |
| 7,360,385 | B1 * | 4/2008 | Wohlenhaus | B21D 7/024 | 72/149 |
| 7,870,773 | B2 * | 1/2011 | Tingley, III | B21D 7/024 | 72/157 |
| 2004/0200253 | A1 * | 10/2004 | Schmauder | B21D 7/021 | 72/149 |

* cited by examiner

*Primary Examiner* — Adam J Eiseman
*Assistant Examiner* — Teresa A Guthrie
(74) *Attorney, Agent, or Firm* — Nixon & Vanderhye

(57) ABSTRACT

Disclosed is a tube bending device which includes at least one bending roller mounted to be rotatably movable relative to a frame and at least one crease erasing member. This device is specific in that it includes a plate designed with: reception surfaces to receive, support and position the crease erasing member which is attached thereto, a unit for fixing to the frame, and guide surfaces pivotably connected for the roller.

8 Claims, 11 Drawing Sheets

BENDING DEVICE

This is a non-provisional application which claims priority to French Application No. 1908654 filed Jul. 30, 2019, the entire contents of which is hereby incorporated by reference.

BACKGROUND OF THE INVENTION

Field of the Invention

The present invention relates to the field of tube bending and in particular to adaptations making it possible to optimize the bending operation.

Description of the Related Art

A tube bending machine conventionally comprises a bending roller as well as a crease erasing member.

By means of movable jaws, the tube placed in the bending machine is bent around the bending roller.

The function of the crease erasing member, also called the crease erasing insert, is to avoid, by being in contact with the tube, the creation of creases at the intrados of the bent portion, in particular for difficult bends, that is to say for:

- tubes which thickness is reduced compared to the diameter of the tube and/or,
- bends with a small radius of curvature compared to the diameter of the tube.

This crease erasing member is a fixed wear part which comes as close as possible to the bending roller, the latter turning during the bending of the tube. The positioning of the crease erasing member relative to the bending roller must be very precise in order to operate efficiently and above all not to cause the said crease erasing member to break, this member being very fragile.

Indeed, the latter is conventionally produced in special materials allowing both the guiding and the sliding of the tube during deformation.

The crease erasing member is mounted on a crease erasing member support, usually attached to the bending head. This crease erasing member support has settings to adjust the position of the crease erasing member relative to the bending roller.

A disadvantage of the bending operation lies in the adjustment of the position of the crease erasing member relative to the roller. Indeed, this adjustment requires know-how and therefore one or more particularly qualified operators. In addition, the time required for this adjustment, which depends on said know-how, can be very long.

In addition, incorrect adjustment can result in premature wear and/or breakage of the crease erasing member, which is a fragile and expensive part.

For these reasons, changing the bending tool can therefore require a particularly long operation that affects the productivity of the bending operation.

When several stacked bending rollers are associated on the same axis of the same bending head, with which therefore several erasing members cooperate, the tool is called multi-heights tool. It is understood that in this configuration, for the same reasons as those mentioned above, the bending tools of the prior art are complex and not very rigid.

Thus, current bending devices are expensive and fragile.

For example, U.S. Pat. No. 7,360,385 discloses a tube bending device of the type comprising at least one bending roller mounted to be rotatably movable with respect to a frame and at least one crease erasing member. The design of this device increases the number of parts, presents problems of size and positioning accuracy.

SUMMARY OF THE INVENTION

Considering the above, the applicant conducted research to solve the drawbacks of the bending devices of the prior art.

This research has resulted in the design and production of an innovative bending tool that offers a new relationship between the bending roller and the associated crease erasing member, a configuration that solves the drawbacks aforementioned.

According to the invention, the tube bending device comprises at least one bending roller mounted so as to be rotatably movable relative to a frame and at least one crease erasing member. This device is specific in that it includes a plate designed with:

- reception surfaces to receive, support and position said crease erasing member attached thereto,
- a fixing means for fixing to said frame,
- guide surfaces pivotably connected to said roller, being pre-formed with at least one bore allowing the guidance of the cylindrical surface of a coaxial cylindrical projection projecting outwardly from one of the upper or lower flat surfaces formed by the roller.

This feature is particularly advantageous in that the crease erasing member and the bending roller are designed as an assembly, but are free to rotate one with respect to the other, which is particularly innovative. The roller and the crease erasing member form a compact unit.

Such a design eliminates the operation of adjusting the crease erasing member relative to the bending roller since these elements are positioned relative to each other by the plate. The adjustment is made once and the tool change does not disturb said settings since the roller and crease erasing member assembly is changed. Indeed, by providing guide surfaces to implement a pivot connection relative to the roller, the plate allows the positioning of the crease erasing member that it receives relative to the axis of rotation of said roller.

Thus, by systematically associating each roller with a crease erasing member pre-positioned relative to the axis of the roller, the tool change is much faster and the experience or know-how of the qualified operator, which was previously necessary, is no longer essential.

According to another particularly advantageous characteristic of the invention, the device comprises an independent crease erasing interface which is inserted between the plate and the crease erasing member. The presence of an interposed part can serve as a mechanical interface between the plate and the crease erasing member, allowing finer adjustments. This interface therefore has the function of the crease erasing member support known from the prior art but, in accordance with the invention, is designed to form an assembly with the plate (and not the frame) which therefore positions it with respect to the axis of rotation of the roller.

According to another particular characteristic of the invention, said roller comprises an upper flat surface and a lower flat surface from one of which outwardly projects at least one coaxial cylindrical projection, said plate being pre-formed with at least a bore allowing the guiding of the cylindrical surface of said projection.

Understandably, the plate according to the invention can have different shapes. Among these, according to another particular characteristic of the invention, said roller comprises an upper flat surface and a lower flat surface from each of which outwardly projects a coaxial cylindrical projection, said plate being comprised of two half-plates, each of which being pre-formed with a bore allowing the guiding of the cylindrical surface of said projection.

The roller is therefore held between two half-plates which leave it free to rotate and which receive the crease erasing member directly or through a crease erasing interface.

According to another particularly advantageous characteristic, when several rollers are stacked, the two half-plates are common to the stack of rollers and to the crease erasing members. The cylindrical guide projections then are only provided on the lower flat surface of the roller located at the bottom of the stack and on the upper flat surface of the roller located at the top of the stack. The device is then particularly compact and precise. It does not require the presence of an additional central shaft, the length of which would depend on the number of rollers to be stacked.

According to another particularly advantageous characteristic of the invention, the crease erasing member is pivotably connected to the plate about an axis parallel to the axis of rotation of the roller, thus allowing rotation of the crease erasing member on a limited number of degrees, allowing the crease erasing member to adapt to the constraints to which the tube is subjected.

When the device includes an independent crease erasing interface, the latter is pivotably connected about an axis parallel to the axis of rotation of the roller allowing a rotation of the interface, and therefore of the crease erasing member, on a limited number of degrees.

The connection between the plate and the crease erasing interface or between the plate and the crease erasing member can receive positioning adjustment means. It will nevertheless be understood that this adjustment is not equivalent to that known from the prior art since when the device according to the invention is moved, the positioning adjustment does not have to be done again.

According to another particularly advantageous characteristic of the invention, the cylindrical projections do not project beyond the outer surfaces of the half-plates. This compactness of the assemblies formed by the assembly of the bending roller and erasing member elements makes it easier to stack the tools. Thus, the device of the invention adopting such a configuration facilitates the superposition:

- of tools of the same radius and with different clamping parts,
- of tools of different radii,
- of different bending direction tools (clockwise and counterclockwise).

By receiving the device or devices according to the invention, the design of the tooling is facilitated. It is the same for its installation.

According to another particular characteristic of the invention, said cylindrical surface of the cylindrical projection is pre-formed with a groove opposite to a corresponding groove pre-formed in the cylindrical surface of the guide bore, a plurality of balls being interposed between the grooves in order to guide in rotation.

The creation of a ball bearing for the purpose of guiding the rotation makes it possible to take better address the constraints of the bending and guarantees good guidance and therefore good positioning of the crease erasing member along the whole bending operation.

The fundamental concepts of the invention having been explained above in their most elementary form, other details and characteristics will become more clearly apparent with the following description and with reference to the accompanying drawings, describing, by way of non-limiting examples, embodiments of a bending device according to the invention.

DESCRIPTION OF THE PREFERRED EMBODIMENTS

Figure 1:
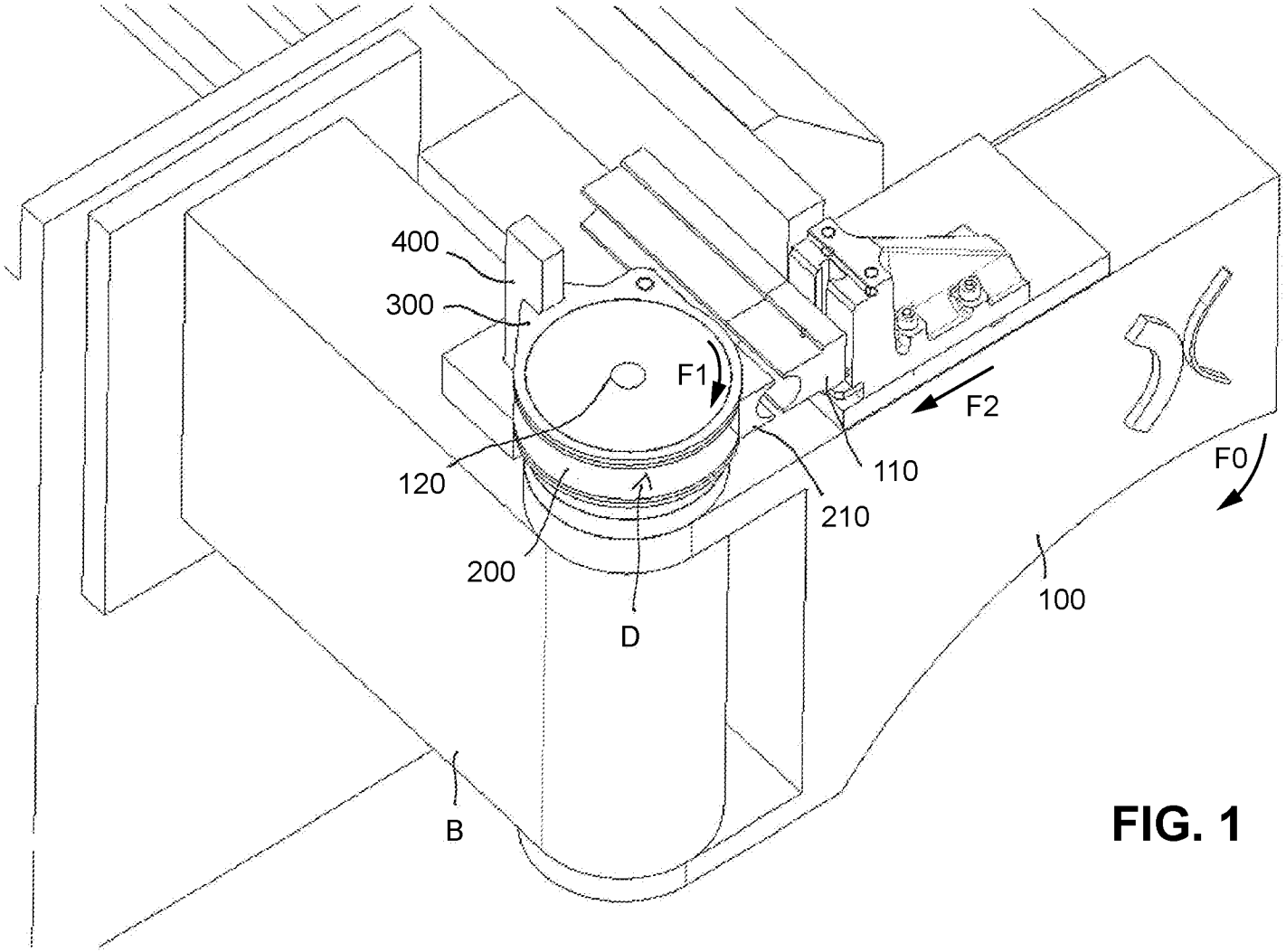
FIG. 1 is a schematic drawing of an exterior perspective top view of a bending head embodying a bending device according to the invention.
Figure 2:
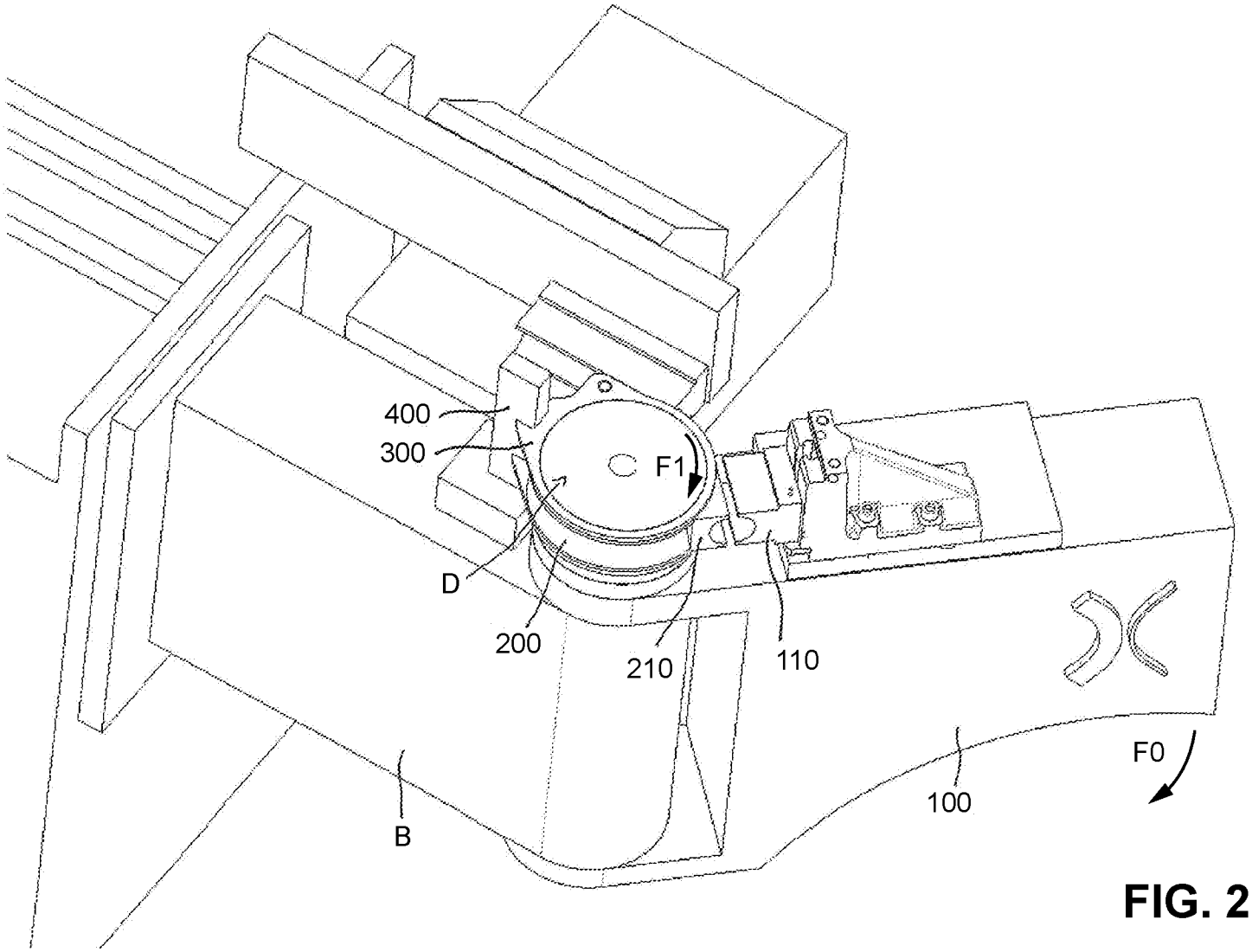
FIG. 2 is a schematic drawing of the bending head of FIG. 1 at the moment of starting the bending.

As illustrated by FIGS. 1 and 2, the bending head comprises a frame B relative to which pivots a bending arm 100 provided with movable jaws 110, according to the arrow F0, about a shaft 120. On this shaft 120, is mounted a bending device denoted D comprising a bending roller 200 associated by means of a plate or yoke 300 to a crease erasing member (which is not shown in these figures).

The plate 300 is fixed in rotation to the frame B by the key 400.

The rolling surface of the roller 200 is equipped with a jaw 210 opposite which the movable jaw 110 of the bending arm 100 is positioned, the jaws facing each other. The end of the tube to be bent (not shown) fits between these jaws 110 and 210 before bending, which jaws are tightened (arrow F2) and the rotation according to the arrow F1 around the roller 200 starts as illustrated in FIG. 2.

Figure 6:
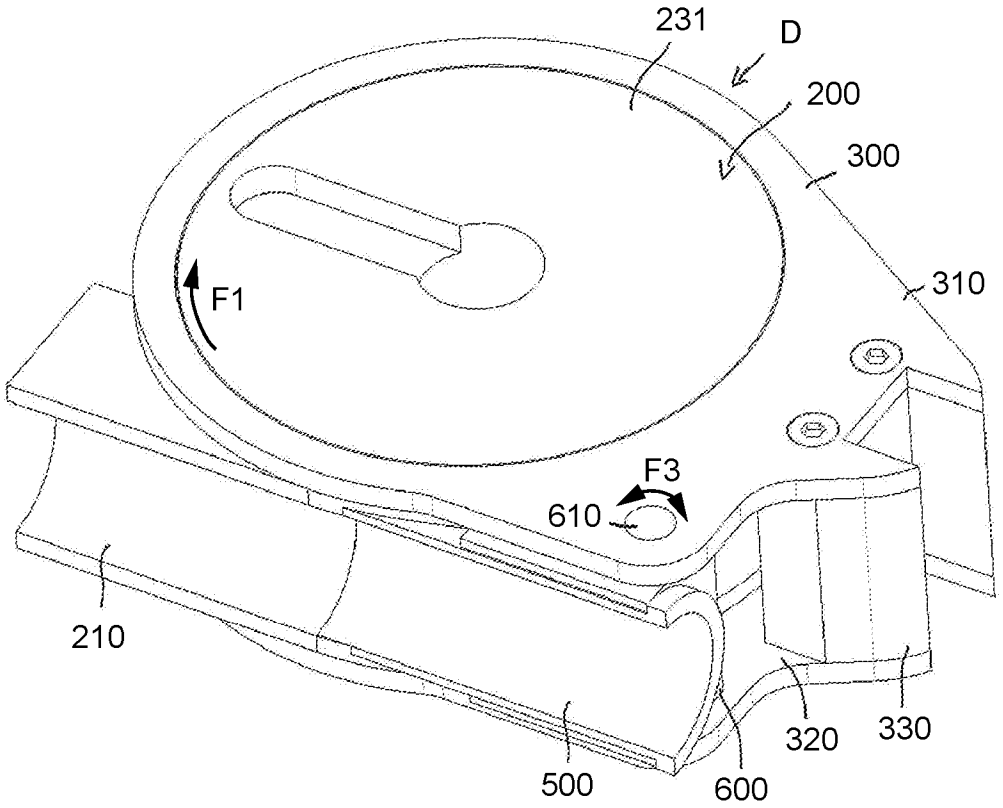
FIG. 6 is a schematic drawing of a more detailed exterior perspective top view of the bending device alone, installed in the bending head of FIG. 1.
Figure 7:
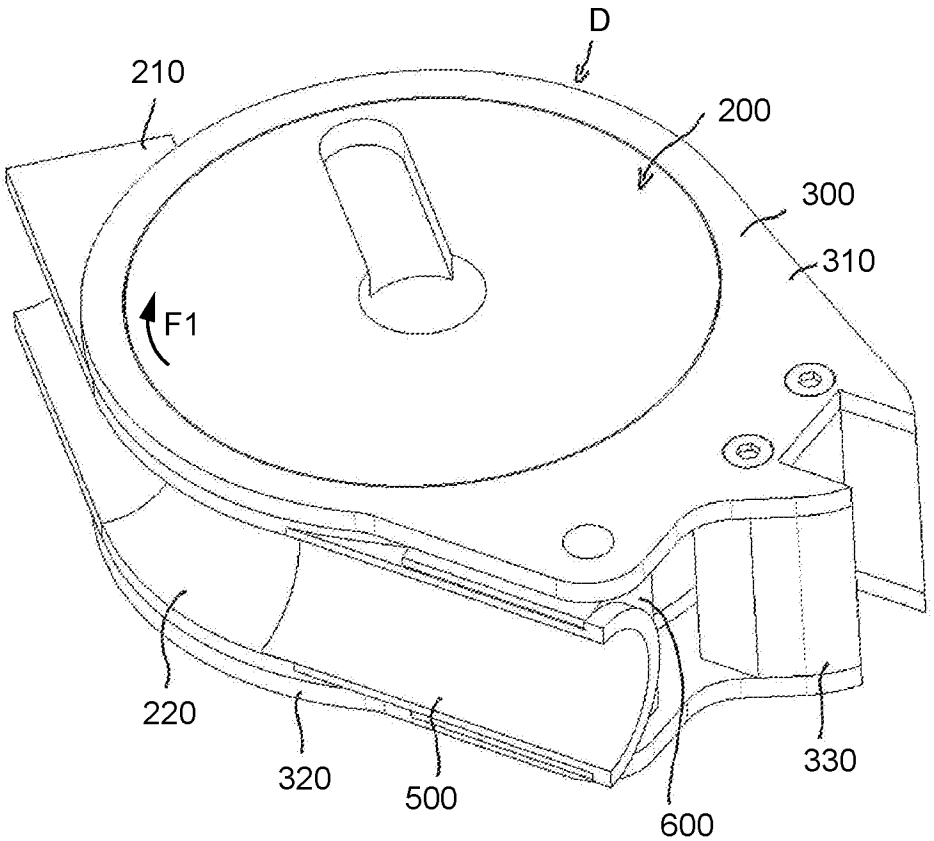
FIG. 7 is a schematic drawing of an exterior perspective top view of the bending device of FIG. 6 in an angular position corresponding to the start of the bending.
Figure 8:
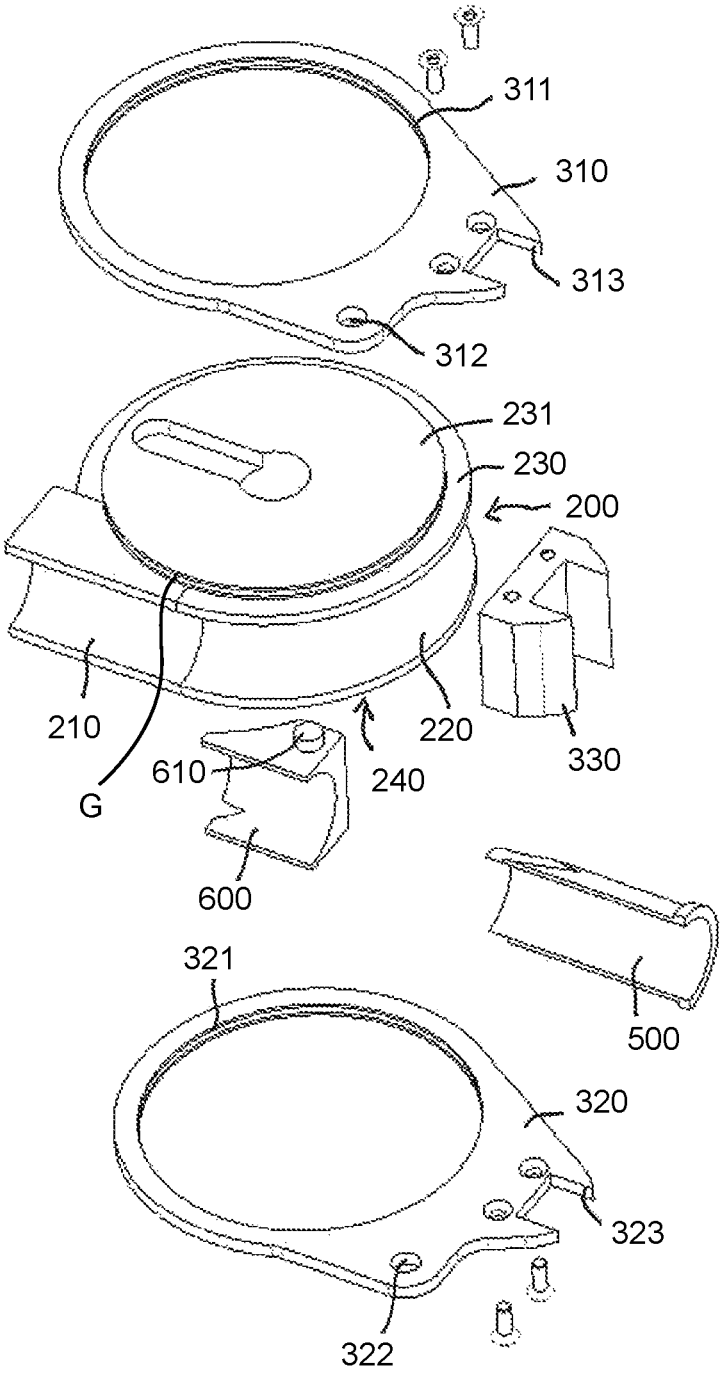
FIG. 8 is a schematic drawing of an exploded exterior perspective top view of the bending device of FIG. 6.

As illustrated by FIGS. 6, 7 and 8, the tube bending device denoted D as a whole comprises at least one bending roller 200 rotatably mounted and a crease erasing member 500 associated with a crease erasing interface 600. According to the invention, the device further comprises a fixed plate 300 comprised of two identical half-plates 310 and 320 arranged one above the other so as to form a guide bearing for the roller 200 as well as a receiving surface for receiving, supporting and positioning the crease erasing interface 600, which in turn receives the crease erasing member 500. As explained above, the roller 200 is guided in rotation around the fixed shaft 120. Thus, the function of the guide bearing of the plate 300 is to make it possible to precisely position the receiving surfaces of the crease erasing interface 600 with respect to the axis of rotation of the roller 200 without hindering the rotation of said roller 200.

According to an embodiment not shown, said plate is made in a single part equivalent to a single half-plate, guiding the roller at only one of its flat surfaces.

The start of the rotation according to the arrow F1 of the roller 200 is illustrated by the drawing of FIG. 7 where the jaw 210 associated with said roller 200 moves away from the crease erasing member 500, being gradually replaced by the groove 220 occupying the rest of the rolling surface of said roller 200.

According to the illustrated embodiment, the crease erasing interface 600 and therefore the crease erasing member 500 are pivotally mounted (arrow F3) relative to the plate 300 about an axis parallel to the axis of rotation of the roller 200 and according to a limited number of degrees in order to allow an angular movement allowing an adaptation of the crease erasing member 500 to the constraints to which it is subjected during the bending.

In more detail, as illustrated in FIG. 8, the two half-plates 310 and 320 are identical and arranged one above the other, sandwiching the roller 200 and the crease erasing interface 600.

To this end, each half-plate 310 and 320 consists of a flat sheet cut so as to be provided with:

a large central hole 311 and 321, a small side hole 312, 322, a notch 313, 323.

The large central hole 311 and 321 serves to receive, guide and retain the roller 200.

The small side hole 312 and 322 is used for receiving, guiding and retaining the crease erasing interface 600.

The notch 313 and 323 is intended to cooperate with the key 400 fixed to the frame (see FIG. 1).

As illustrated, the crease erasing interface 600 is inserted between the inner faces of the half-plates 310 and 320 facing each other, and receives the crease erasing member 500. Cylindrical projections 610 projecting from the crease erasing interface cooperate with the holes 312 and 322. The positioning of this crease erasing member 500 relative to roller 200 can therefore be very precise and positioned only once without the movement of the device disturbing it. A connecting spacer 330 is inserted between the two half-plates 310 and 320 to ensure the connection between the latter while allowing the rotation of the crease erasing interface 600 and of the roller 200. This spacer 330 is pre-formed to take up the profile of the notches 313 and 323 and also cooperates to the connection with the key 400.

Said roller 200 comprises an upper flat surface 230 and a lower flat surface 240 from each of which outwardly projects a coaxial cylindrical projection (only the one numbered 231 appears due to the point of view).

These cylindrical projections will cooperate with the cylindrical surfaces of the holes 311 and 321 formed in the half-plates 310 and 320 for the purpose of guiding and retaining the roller 200.

Figure 3:
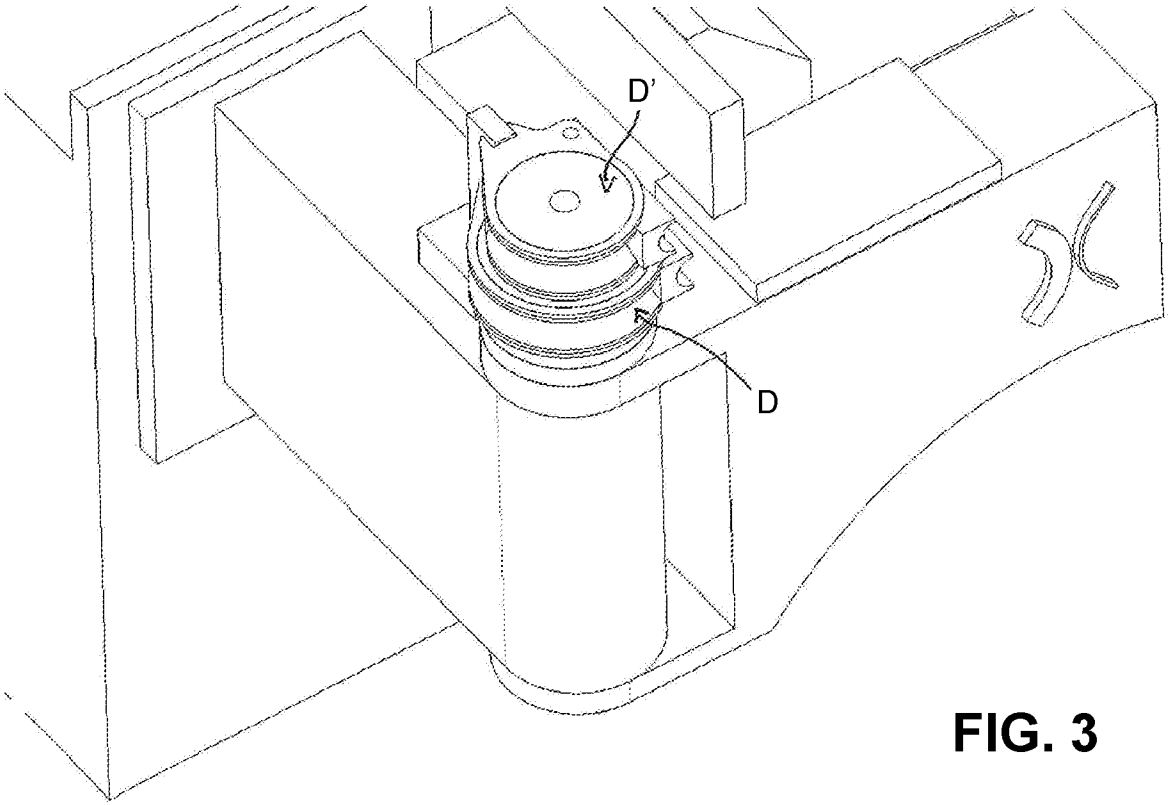
FIG. 3 is a schematic drawing of an exterior perspective top view of a bending head in which several rollers operating in the same bending direction are stacked.
Figure 5:
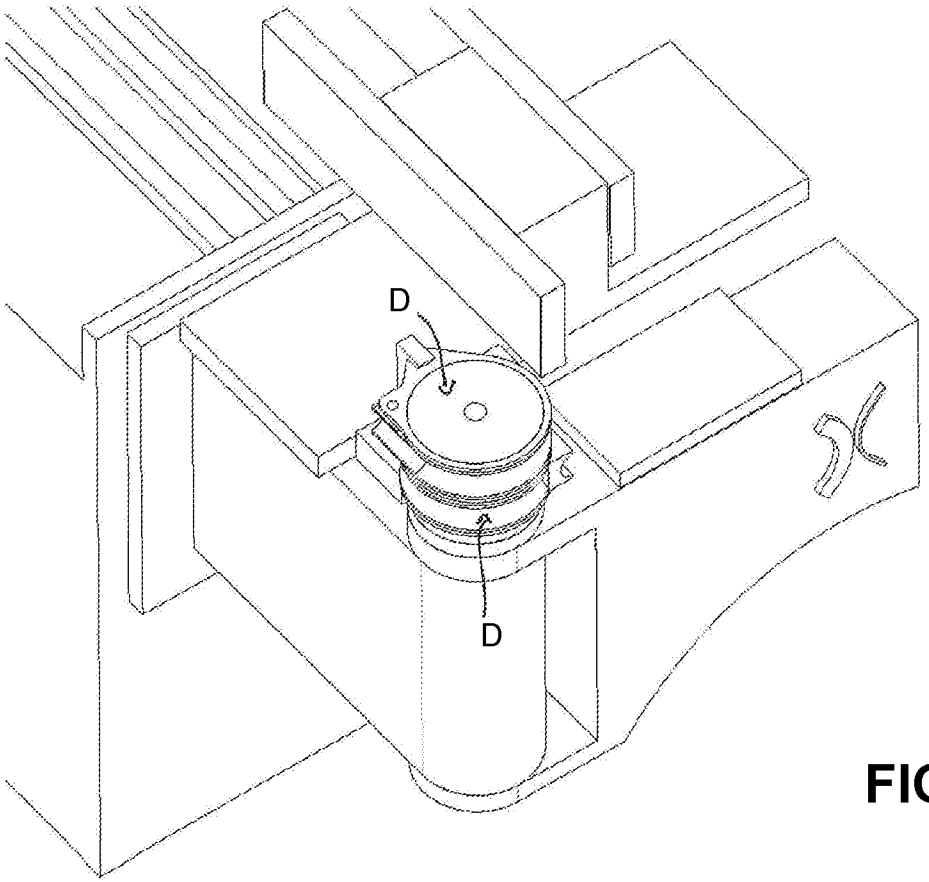
FIG. 5 is a schematic drawing of an exterior perspective top view of a bending head in which two rollers operating in the reverse bending direction are stacked.

As illustrated in the drawing of FIG. 6, once the device D is mounted, the cylindrical projections (only 231 appears) do not project beyond the outer surfaces of the half-plates 310 and 320. This characteristic facilitates the stacking of the devices to create simple, inexpensive and rigid multi-height bending tools. An example of such a tool is illustrated in FIG. 3 where, above device D, is stacked coaxially a device D' having a smaller roller diameter. Another example of such a tool is illustrated in FIG. 5 where, above a first device D, is stacked coaxially another device D inverted so as to operate in the opposite direction of rotation with respect to the first one.

Figure 4:
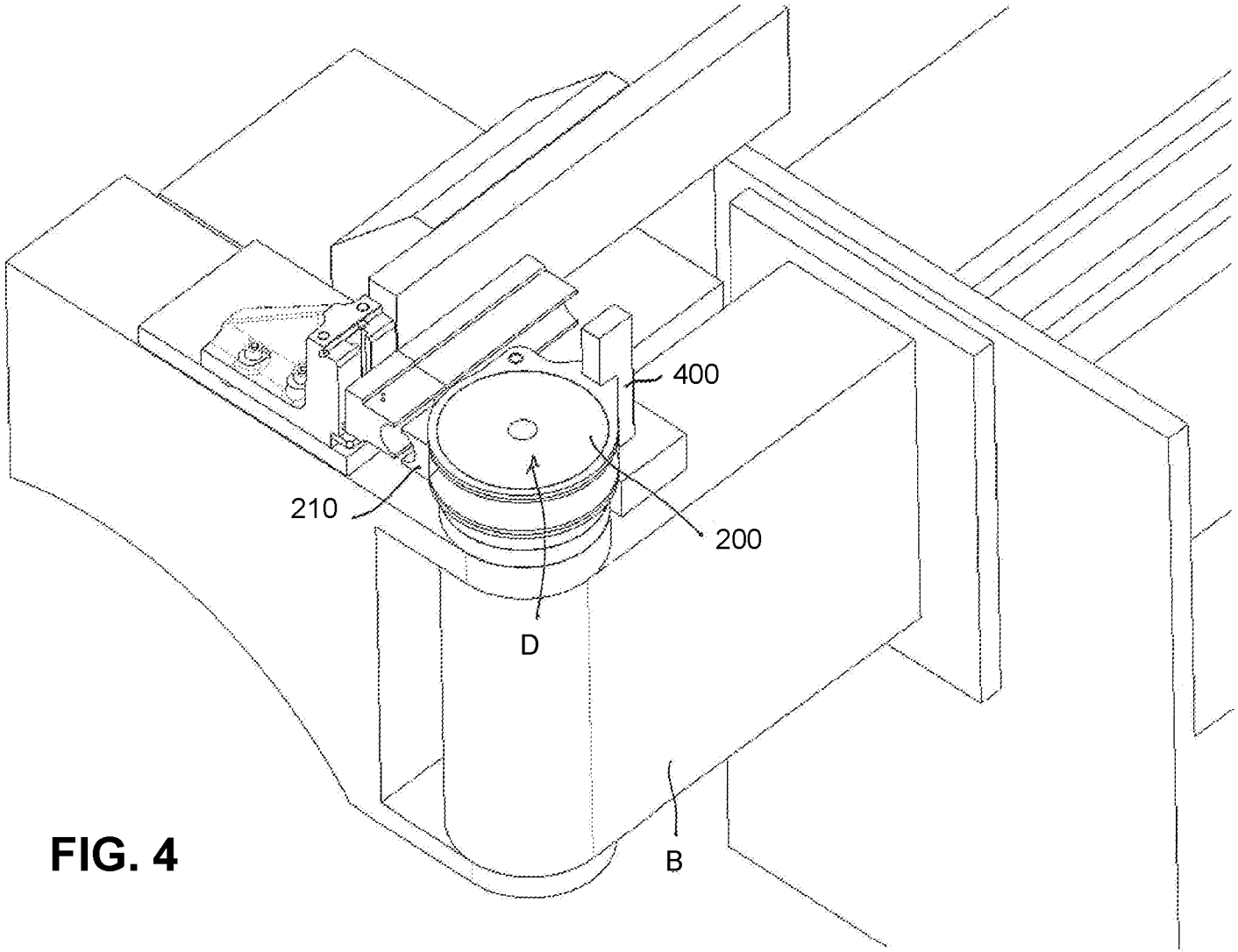
FIG. 4 is a schematic drawing of an exterior perspective top view of a bending head for bending in the opposite direction to that implemented by the bending head of FIG. 1.

It is thus understood that such a configuration favors the use of the same device in the opposite direction of bending: it is indeed sufficient to turn the device D as illustrated in FIG. 4. Provided that the crease erasing member always remains associated with the roller, it is no longer necessary to review the position adjustment.

According to an embodiment, said cylindrical surface of the cylindrical projection (only 231 appears) is pre-formed with a groove G located opposite a corresponding groove pre-formed in the cylindrical surface of the guide bore (311 and 321), a plurality of balls (not shown) being inserted between the grooves in order to guide in rotation.

Figure 9:
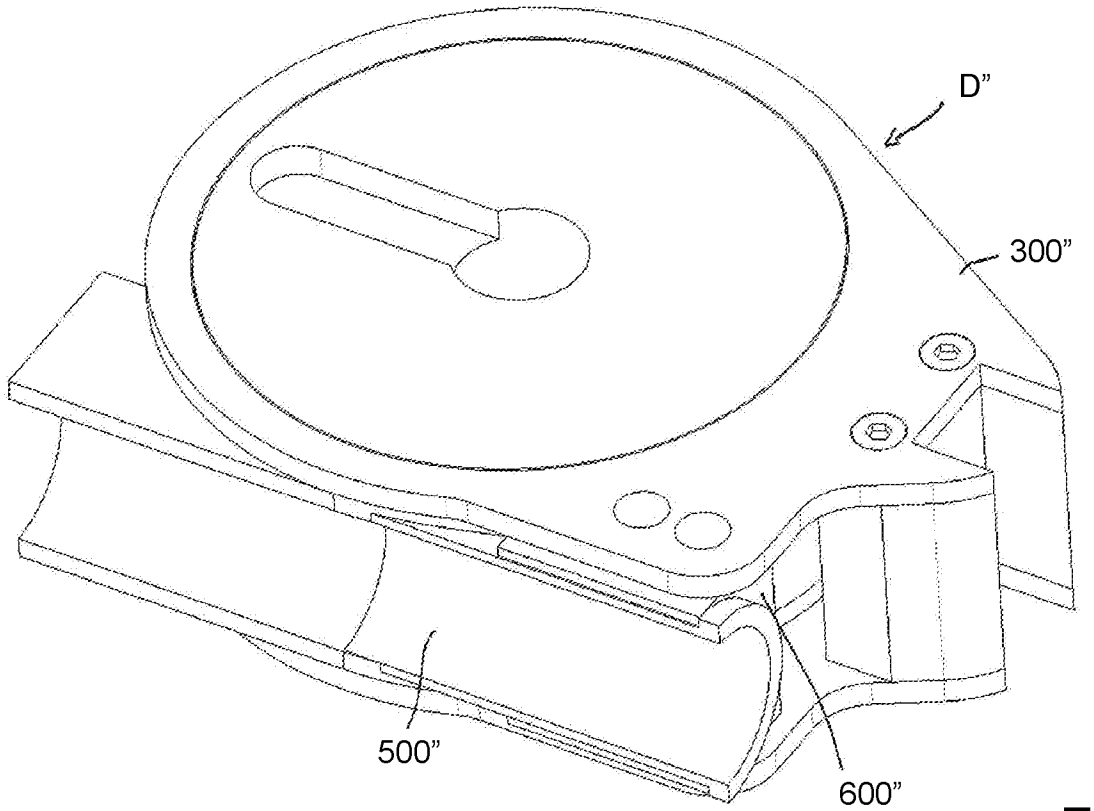
FIG. 9 is a schematic drawing of an exterior perspective top view of another embodiment of a bending device according to the invention.

FIG. 9 illustrates another embodiment of the bending device D" where the crease erasing interface 600" is retained by two fixing points on the plate 300" and therefore does not allow degrees of freedom to position the crease erasing member 500".

Figure 10:
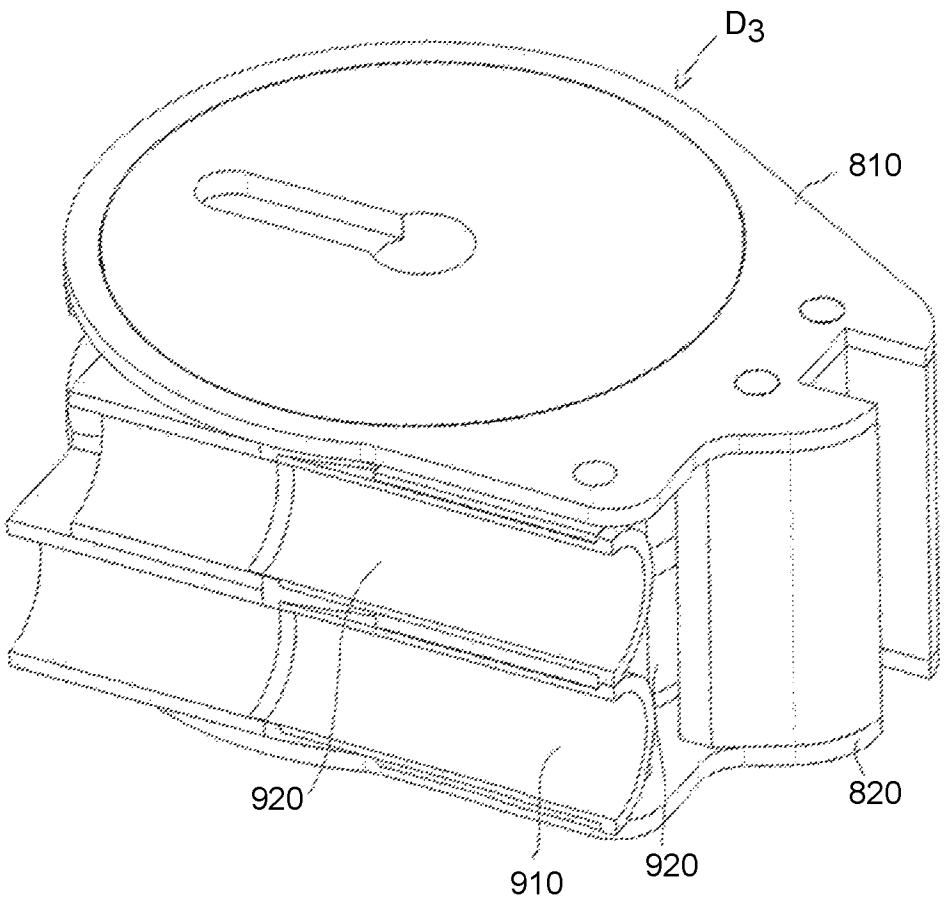
FIG. 10 is a schematic drawing of an exterior perspective top view of another embodiment of a bending device according to the invention.
Figure 11:
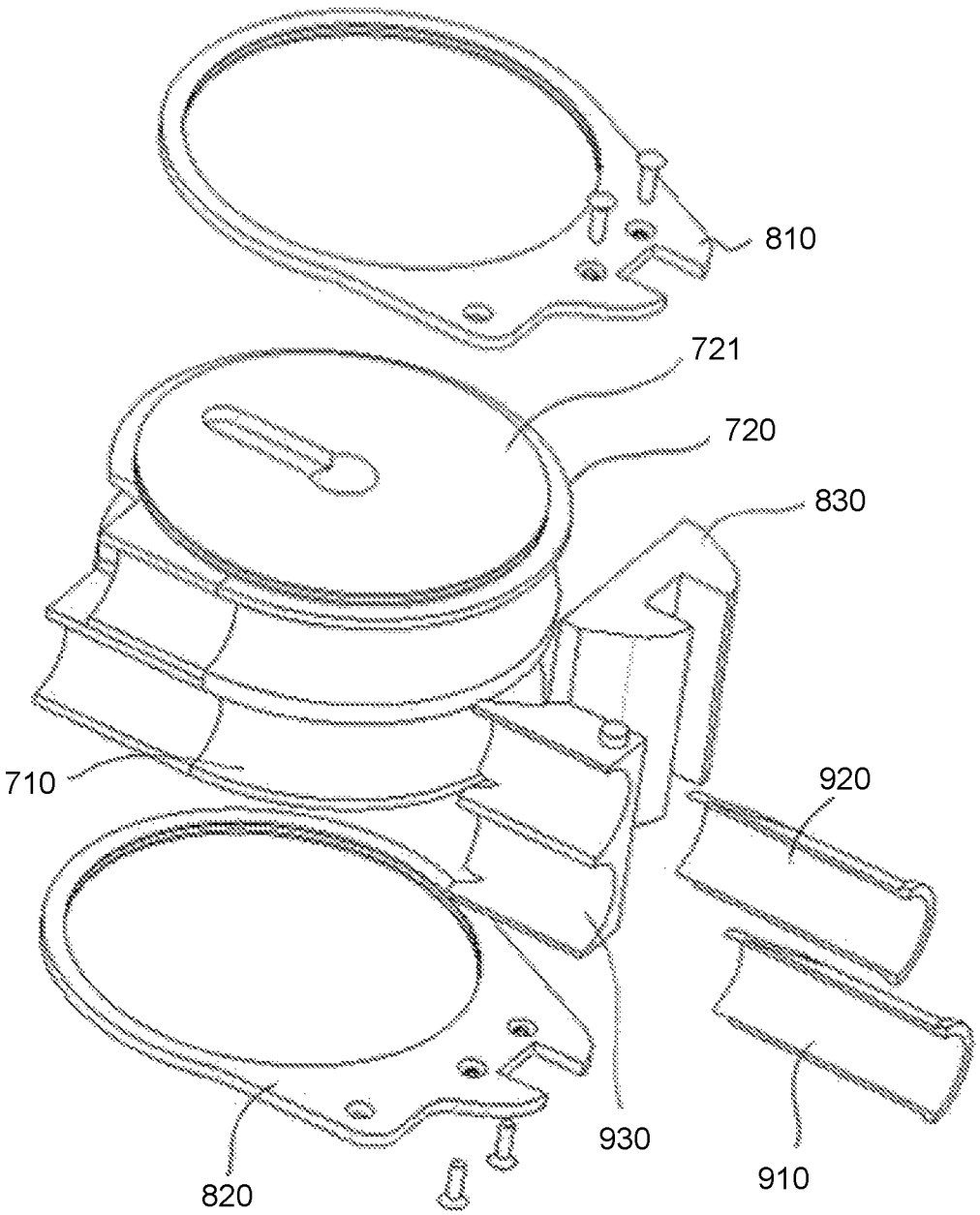
FIG. 11 is a schematic drawing of an exploded exterior perspective top view of the bending device of FIG. 10.

FIGS. 10 and 11 illustrate one embodiment of a stacked configuration. The design of the device of the invention makes this configuration particularly compact. In this device D3, two rollers 710 and 720 are stacked. Only the upper flat surface of the upper roller 720 and the lower flat surface of the lower roller are pre-formed with a cylindrical projection for guidance purposes (for drawing reasons, only the projection 721 of the roller 720 appears). The upper flat surface of the lower roller 710 and the lower flat surface of the upper roller 720 combine one with the other. Consequently, only two half-plates 810 and 820 are necessary despite the doubling of the rollers.

As illustrated, a plurality of elements are used in common in this stacked configuration.

Thus, two crease erasing members 910 and 920 (one for each roller) are necessary but a single crease erasing interface 930 ensures their fixing and their positioning relative to the roller with which it cooperates. This crease erasing interface 910 is linked to the upper half-plate 810 and to the lower half-plate 820. Likewise, a single connecting spacer 830 is implemented.

It is understood that the bending devices which have been described and shown above have been described and shown for the purpose of disclosure rather than limitation. Of course, various arrangements, modifications and improvements can be made to the above examples, without departing from the scope of the invention. It is thus understood that despite the fact that the illustrated embodiments illustrate the presence of a crease erasing interface, the plate can as well directly receive the crease erasing member without an intermediate part in accordance with the invention.

The invention claimed is:

1. A device for bending tubes, comprising:

a bending roller (200) mounted to be rotatably movable with respect to both a frame (B) and a crease erasing member (500), the bending roller formed as one piece and having an upper horizontal surface (230) and a lower horizontal surface (240), the upper surface (230) of the bending roller comprising a vertical step by which a horizontal first portion of the upper surface rises vertically from a horizontal second portion of the upper surface to form an upper coaxial cylindrical projection (231) circumferentially surrounded by the second portion of the upper surface, and the lower surface (240) including a lower coaxial cylindrical projection formed thereon that extends vertically from the lower surface (240); and a plate (300) for associating the bending roller with the crease erasing member to form a unit, said plate (300) comprised of a fixing means for fixing to said frame (B), and two half-plates which receive the crease erasing member, each of said two half-plates pivotably connected to said bending roller (200), said two half-plates each being pre-formed with a guide bore, the guide bores of said two half-plates respectively arranged to receive the upper coaxial cylindrical projection and the lower coaxial cylindrical projection, each of the guide bores having an inner circumferential surface configured to cooperate with respective cylindrical surfaces of the upper coaxial cylindrical projection and the lower coaxial cylindrical projection in order to guide the bending roller (200).

2. The device according to claim 1, further comprising:

a crease erasing interface (600), configured to be inserted between the plate (300) and the crease erasing member (500).

3. The device according to claim 1, wherein the crease erasing member (500) is pivotally connected to the plate (300) about an axis spaced from and parallel to an axis of rotation of the bending roller (200) allowing a rotation of the crease erasing member (500).

4. The device according to claim 1, wherein each of the two half-plates have a thickness corresponding respectively to a height of the upper coaxial cylindrical projection and a height of the lower coaxial cylindrical projection, such that respective uppermost and lowermost surfaces of the upper and lower coaxial cylindrical projections of the bending roller (200) do not project beyond respective uppermost and lowermost surfaces of the two half-plates.

5. The device according to claim 1, wherein said cylindrical surfaces of the upper and lower coaxial cylindrical projections of the bending roller (200) are each pre-formed with a groove facing a corresponding groove pre-formed in a cylindrical surface of the guide bores of the two half-plates.

6. The device according to claim 2, wherein the crease erasing interface (600) is pivotably connected to the plate (300) about an axis parallel to an axis of rotation of the bending roller (200).

7. A device for bending tubes, comprising:

a first bending roller (720);

a second bending roller (710) stacked beneath the first bending roller (720), the first and second bending rollers (720, 710) forming a stacked configuration, the stacked configuration mounted to be rotatably movable with respect to both a frame (B) and first and second crease erasing members (920, 910), the first bending roller (720) including an upper horizontal surface comprising a vertical step by which a horizontal first portion of the upper surface rises vertically from a horizontal second portion of the upper surface to form an upper coaxial cylindrical projection (721) circumferentially surrounded by the second portion of the upper surface, and the second bending roller (710) including a lower surface with a lower coaxial cylindrical projection; and a plate for associating the bending rollers with the crease erasing members (920, 910) to form a unit, said plate comprised of a fixing means for fixing to said frame (B), and two half-plates which receive the crease erasing members, each of said two half-plates pivotably connected to one of said first and second bending rollers (720, 710), said two half-plates each being pre-formed with a guide bore, the guide bores of said two half-plates respectively arranged to receive the upper coaxial cylindrical projection and the lower coaxial cylindrical projection, each of the guide bores having an inner circumferential surface configured to cooperate with respective cylindrical surfaces of the upper coaxial cylindrical projection and the lower coaxial cylindrical projection in order to guide the first and second bending rollers (720, 710), wherein the two half-plates are arranged common to the stacked configuration of the first and second bending rollers (720, 710) and the crease erasing members (910, 920), the upper and lower coaxial cylindrical projections respectively forming an upper surface of the stacked configuration and a lower surface of the stacked configuration.

8. The device according to claim 7, further comprising:

a crease erasing interface, configured to be inserted between the plate and the crease erasing members.

* * * * *